US007850268B2

(12) United States Patent
Katsu

(10) Patent No.: US 7,850,268 B2
(45) Date of Patent: Dec. 14, 2010

(54) RECORDING METHOD AND RECORDING APPARATUS

(75) Inventor: Takuji Katsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 272 days.

(21) Appl. No.: 11/455,435

(22) Filed: Jun. 19, 2006

(65) Prior Publication Data

US 2006/0290720 A1 Dec. 28, 2006

(30) Foreign Application Priority Data

Jun. 28, 2005 (JP) ..... 2005-188292

(51) Int. Cl.
*B41J 29/38* (2006.01)

(52) U.S. Cl. ..... 347/14; 347/12

(58) Field of Classification Search ..... 347/12, 347/14

See application file for complete search history.

(56) References Cited

U.S. PATENT DOCUMENTS 5,686,944 A * 11/1997 Takagi et al. ..... 347/41
6,460,976 B1 10/2002 Oikawa
6,960,036 B1 11/2005 Fujita et al.
2003/0193536 A1* 10/2003 Kuronuma et al. ..... 347/9
2006/0044334 A1 3/2006 Fujita et al.

FOREIGN PATENT DOCUMENTS

JP 5-84899 A 4/1993
JP 2000-71433 A 3/2000
JP 2001-129985 A 5/2001

* cited by examiner

*Primary Examiner*—Julian D Huffman
(74) *Attorney, Agent, or Firm*—Canon USA Inc IP Division

(57) ABSTRACT

A recording method includes transferring recording data to a recording head having a nozzle array at a read timing for each of nozzle groups of the nozzle array according to information on misalignment of the nozzle array, and a driving the recording head for each of the groups for predetermined periods by inputting the transferred recording data. Each respective predetermined period includes a plurality of drive start timings for recording. One of the drive start timings is selected for each of the groups according to the information on the misalignment of the nozzle array.

14 Claims, 16 Drawing Sheets

(PRIOR ART)

FIG. 3

| BLK NUM | NOZZLE No. | | | | | | | | | | | |
|---|---|---|---|---|---|---|---|---|---|---|---|---|
| BE0 | 176 | 160 | 144 | 128 | 112 | 96 | 80 | 64 | 48 | 32 | 16 | 0 |
| BE1 | 177 | 161 | 145 | 129 | 113 | 97 | 81 | 65 | 49 | 33 | 17 | 1 |
| BE2 | 178 | 162 | 146 | 130 | 114 | 98 | 82 | 66 | 50 | 34 | 18 | 2 |
| BE3 | 179 | 163 | 147 | 131 | 115 | 99 | 83 | 67 | 51 | 35 | 19 | 3 |
| BE4 | 180 | 164 | 148 | 132 | 116 | 100 | 84 | 68 | 52 | 36 | 20 | 4 |
| BE5 | 181 | 165 | 149 | 133 | 117 | 101 | 85 | 69 | 53 | 37 | 21 | 5 |
| BE6 | 182 | 166 | 150 | 134 | 118 | 102 | 86 | 70 | 54 | 38 | 22 | 6 |
| BE7 | 183 | 167 | 151 | 135 | 119 | 103 | 87 | 71 | 55 | 39 | 23 | 7 |
| BE8 | 184 | 168 | 152 | 136 | 120 | 104 | 88 | 72 | 56 | 40 | 24 | 8 |
| BE9 | 185 | 169 | 153 | 137 | 121 | 105 | 89 | 73 | 57 | 41 | 25 | 9 |
| BE10 | 186 | 170 | 154 | 138 | 122 | 106 | 90 | 74 | 58 | 42 | 26 | 10 |
| BE11 | 187 | 171 | 155 | 139 | 123 | 107 | 91 | 75 | 59 | 43 | 27 | 11 |
| BE12 | 188 | 172 | 156 | 140 | 124 | 108 | 92 | 76 | 60 | 44 | 28 | 12 |
| BE13 | 189 | 173 | 157 | 141 | 125 | 109 | 93 | 77 | 61 | 45 | 29 | 13 |
| BE14 | 190 | 174 | 158 | 142 | 126 | 110 | 94 | 78 | 62 | 46 | 30 | 14 |
| BE15 | 191 | 175 | 159 | 143 | 127 | 111 | 95 | 79 | 63 | 47 | 31 | 15 |

FIG. 14

| FIRST BLOCK | SECOND BLOCK | THIRD BLOCK | FOURTH BLOCK | FIFTH BLOCK | SIXTH BLOCK | SEVENTH BLOCK | EIGHTH BLOCK |
|---|---|---|---|---|---|---|---|
| FIRST COLOR DATA | FIRST COLOR DATA | FIRST COLOR DATA | FIRST COLOR DATA | FIRST COLOR DATA | FIRST COLOR DATA | FIRST COLOR DATA | FIRST COLOR DATA |
| SECOND COLOR DATA | SECOND COLOR DATA | SECOND COLOR DATA | SECOND COLOR DATA | SECOND COLOR DATA | SECOND COLOR DATA | SECOND COLOR DATA | SECOND COLOR DATA |
| THIRD COLOR DATA | THIRD COLOR DATA | THIRD COLOR DATA | THIRD COLOR DATA | THIRD COLOR DATA | THIRD COLOR DATA | THIRD COLOR DATA | THIRD COLOR DATA |
| FOURTH COLOR DATA | FOURTH COLOR DATA | FOURTH COLOR DATA | FOURTH COLOR DATA | FOURTH COLOR DATA | FOURTH COLOR DATA | FOURTH COLOR DATA | FOURTH COLOR DATA |
| FIFTH COLOR DATA | FIFTH COLOR DATA | FIFTH COLOR DATA | FIFTH COLOR DATA | FIFTH COLOR DATA | FIFTH COLOR DATA | FIFTH COLOR DATA | FIFTH COLOR DATA |
| SIXTH COLOR DATA | SIXTH COLOR DATA | SIXTH COLOR DATA | SIXTH COLOR DATA | SIXTH COLOR DATA | SIXTH COLOR DATA | SIXTH COLOR DATA | SIXTH COLOR DATA |
| SEVENTH COLOR DATA | SEVENTH COLOR DATA | SEVENTH COLOR DATA | SEVENTH COLOR DATA | SEVENTH COLOR DATA | SEVENTH COLOR DATA | SEVENTH COLOR DATA | SEVENTH COLOR DATA |
| EIGHTH COLOR DATA | EIGHTH COLOR DATA | EIGHTH COLOR DATA | EIGHTH COLOR DATA | EIGHTH COLOR DATA | EIGHTH COLOR DATA | EIGHTH COLOR DATA | EIGHTH COLOR DATA |

RECORDING METHOD AND RECORDING APPARATUS

BACKGROUND OF THE INVENTION

1. Field of the Invention

The present invention relates to recording (printing) methods and apparatuses for driving a recording head (print head) having a nozzle array.

2. Description of the Related Art

The recent development of personal computers has been accompanied by dramatic advances in printer technology which have enabled high-quality image outputs. Such high-quality recording (printing) may require performing a registration process (e.g., calibration process) to correct misalignment problems.

Various techniques have been implemented to correct a misalignment of positions where ink droplets of different colors are landed or positions where ink-droplets of the same color are landed in opposite scanning directions of a recording head in bidirectional printing.

One common type of recording heads (print heads) is a color print head having two nozzle arrays for each color, a large-dot nozzle array and a small-dot nozzle array, for example, as shown in FIG. 2. The number of nozzles may be increased to achieve higher print speeds. In the example of FIG. 2, the large-dot and small-dot nozzle arrays each include 192 nozzles.

Japanese Patent Laid-Open No. 2000-71433 discloses one of the generally used methods for driving a print head. In this method, nozzle arrays extending in a column direction (sub-scanning direction) are each divided into nozzle blocks every predetermined number of nozzles. These blocks are driven at different timings. The time-division driving allows for increased ink-supply speed and stability and reduced power consumption required for ejection.

FIG. 3 is a table showing a configuration of an example of a nozzle array divided into 16 blocks. As shown in this table, nozzles are grouped into blocks every 16 nozzles. That is, nozzles separated at intervals of a predetermined number of nozzles are grouped into the same block so that the adjacent nozzles can be driven with a reduced effect on each other.

Japanese Patent Laid-Open No. 2001-129985 discloses a registration method for correcting a misalignment of positions where ink droplets of different colors are landed or positions where ink droplets of the same color are landed in opposite scanning directions in bidirectional printing.

Japanese Patent Laid-Open No. 5-84899 discloses a method for correcting a misalignment of positions where ink droplets are landed at different print speeds. In this method, the time intervals (t) for time-division driving are controlled according to the print speeds. That is, the time intervals (t) are decreased for high-speed printing and are increased for low-speed printing to avoid a misalignment of positions where ink droplets are landed.

Some printers include a memory (RAM) with a limited memory capacity for cost reduction. Such printers generally lower the resolution of print data in a main scanning direction because of the limited memory capacity, and thus repeat scanning in the main scanning direction (multipass printing) for dot interpolation. According to this method, if the actual print resolution of data stored in a memory of a printer is 600 dpi, scanning may be repeated eight times at 600 dpi in multipass printing to achieve a print resolution of 4,800 dpi in the main scanning direction.

If recording image data with a relatively low actual resolution, for example, 600 dpi, in the main scanning direction is printed directly at the recording resolution, a column of image data is distributed at 600 dpi by time-division driving. In conventional printing methods, therefore, the positions where dots are recorded can be adjusted only in units of 600 dpi, and nozzle registration can be performed only in units of 600 dpi accordingly.

In addition, recording methods adapted for recording heads having increased numbers of nozzles have been in demand.

Furthermore, the inclination (misalignment) of a nozzle array can be caused by variations in the production of print heads or a poor fit between a print head and a carriage provided on a printer. Thus, a deviation in ejection direction between nozzles (for example, nozzles 0 and 191 in FIG. 2) may need to be corrected.

Registration methods are typified by the shift of print data by a plurality of pixels, or a half of a pixel, of a recording resolution (print resolution) in units of a column and the shift of the reference timing for printing by a predetermined period.

The shift of print data by a plurality of pixels in units of a column, for example, is intended to roughly correct a misalignment of positions where ink droplets of different colors are landed or positions where ink droplets of the same color are landed in opposite scanning directions in bidirectional printing. The data shift can be performed in units of 600 dpi for printing at 600 dpi. The data shift can also be performed by a half of a pixel of a print resolution, 1,200 dpi for the above example. The shift of the reference timing for printing by a predetermined period is performed within the period corresponding to one column. The print timing can be shifted in units of a basic clock cycle for operation of a printer system. This type of shift is intended to correct a slight misalignment due to, for example, variations in individual head products and differences in recording environments.

Although the position where printing is started can be shifted in the methods described above, the time intervals for time-division driving in ejection from nozzle blocks of each column are not changed. If, for example, printing is performed at a print speed (carriage speed) of 40 inch/sec and a resolution of 600 dpi, the time required for ejection from all nozzles of each column is represented by the following equation:

$$T\text{column}=(1/40(\text{inch/sec}))/600(\text{dpi})=41\ \mu s$$

One of the commonly employed methods for defining the time intervals for ejection for each column is the use of an encoder disposed on a carriage to read a scaler extending in the direction in which the carriage moves. Using this method, ejection intervals are uniformly defined for the individual columns in a print region where the carriage moves at a constant speed.

The time intervals for driving the blocks of each column are determined by dividing the time interval for ejection for each column by the number of blocks. Under the above conditions, for example, the time interval for ejection from each of the 16 blocks is represented by the following equation:

$$T\text{block}=T\text{column}/16(\text{blocks})=2.60\ \mu s$$

Thus, time intervals are uniformly defined both for columns and for blocks according to the reference timing for printing. The time interval for ejection for each column is not changed because only the timing when ejection is started is shifted by registration. For conventional printers, the time interval for ejection for each column in a raster direction depends on the print speed of a carriage and print resolution.

In practice, however, the time interval for ejection for each column can be assumed to depend on print resolution because the print speed of a carriage is limited to several modes based on the optimum ejection frequency of a print head.

Recent technology has enabled the ejection of significantly reduced volumes of ink droplets, namely, 1 to 2 pl, to achieve printing comparable in quality to film photography. Such fine ink droplets form fine dots on paper. Conventional time-division driving can cause time differences between blocks and thus may fail to align the ejection positions of all nozzles. For conventional print heads, a misalignment of dots formed by time-division driving within a column is negligible because the print heads eject larger volumes of ink droplets, namely, 20 to 50 pl, to form dots overlapping each other on paper.

For the example described above, the time difference between the first block and the sixteenth block is calculated to be about 39 μs. A misalignment of ink droplets with a volume of 2 pl cannot be recognized by the human eye, but can be recognized as a fringe pattern in an image formed on paper.

SUMMARY OF THE INVENTION

Embodiments of the present invention provide a method and apparatus for recording high-quality images without causing dot misalignment.

According to an aspect of the present invention, a method records data by scanning using a recording head having a nozzle array including a plurality of nozzles. The nozzles are divided into groups. The method includes transferring the recording data to the recording head at a read timing for each of the groups of the nozzles according to information on misalignment of the nozzle array, and driving the recording head for each of the groups for predetermined periods by inputting the transferred recording data. Each respective predetermined period includes a plurality of drive start timings for recording. One of the drive start timings is selected for each of the groups according to the information on the misalignment of the nozzle array.

According to another aspect of the present invention, a method is provided for printing data by using a print head having a nozzle array including a plurality of nozzles. The nozzles are divided into groups. The method includes transferring the data to the print head for each of the groups of the nozzles, and selecting at least one of a first driving period and a second driving period for each of the nozzle groups according to misalignment information associated with the nozzles in the nozzle array. The method further includes driving the print head for each of the nozzle groups at the selected one of the first and second driving periods for printing by inputting the transferred data.

According to a further aspect of the present invention, a recording apparatus performs recording by using a recording head having a nozzle array including a plurality of nozzles. The nozzles are divided into groups. The apparatus includes a transfer unit configured to transfer data to the recording head at a read timing for each of the groups according to information on misalignment of the nozzle array, and a drive unit configured to drive the recording head for each of the groups for predetermined periods by inputting the recording data transferred by the transfer unit. The drive unit has first and second driving periods for recording shorter than the predetermined periods. One of the first and second driving periods is selected for each of the groups.

Further features and aspects of the present invention will become apparent from the following description of exemplary embodiments with reference to the attached drawings.

BRIEF DESCRIPTION OF THE DRAWINGS

FIG. 3 is a table illustrating a configuration of an exemplary nozzle array divided into blocks.

FIG. 14 is a diagram illustrating the structure of data stored in a recording buffer according to an exemplary embodiment of the present invention.

DESCRIPTION OF THE EMBODIMENTS

Embodiments of the present invention will now be described in detail with reference to the drawings.

Figure 4:
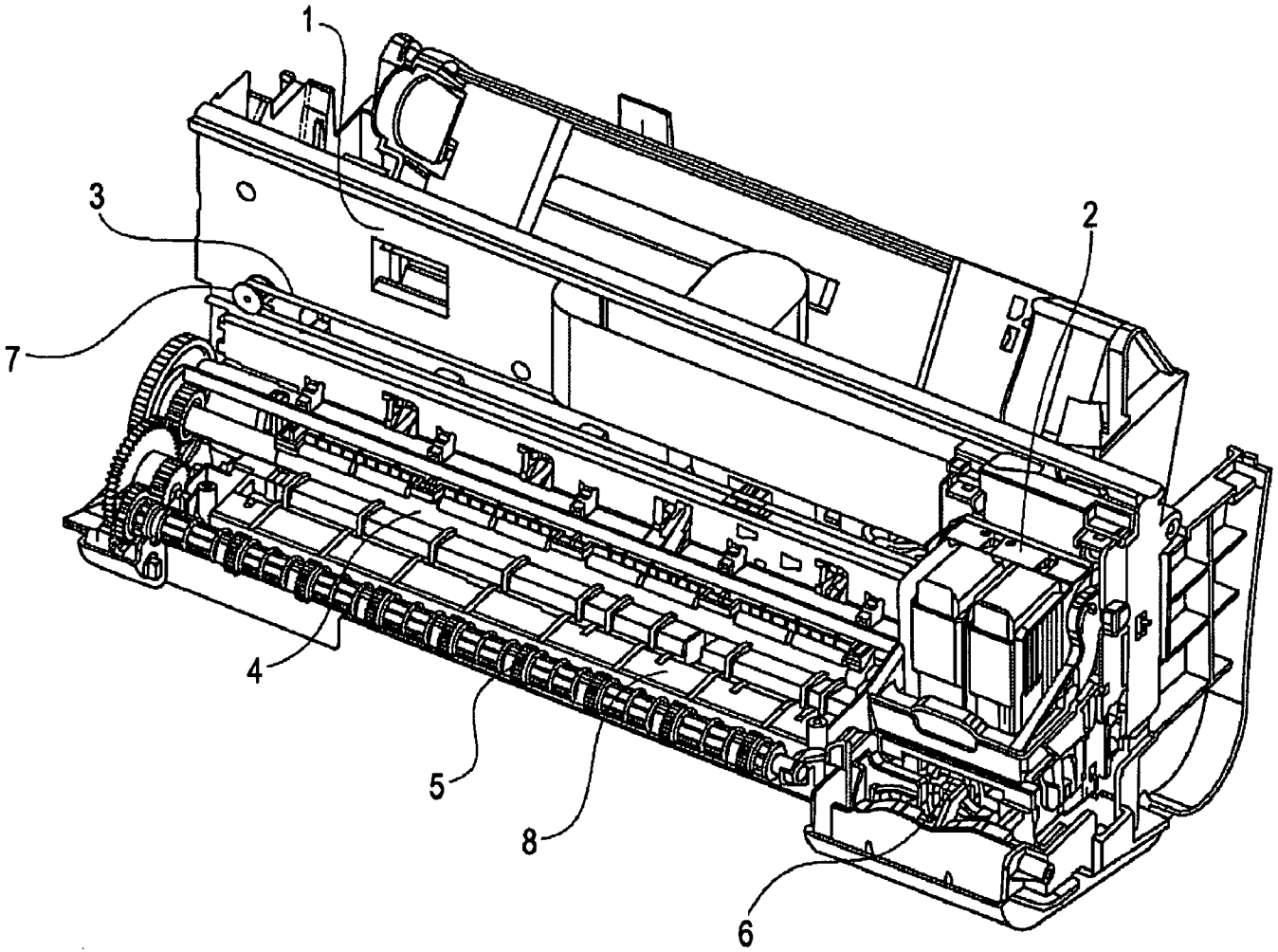
FIG. 4 is a perspective view of a recording apparatus according to an exemplary embodiment of the present invention.

FIG. 4 is a perspective view of a printer (also referred to herein as a "recording apparatus") according to an exemplary embodiment of the present invention. In FIG. 4, a printer 1 generally includes a carriage 2, a timing belt 3, a feed roller 4, an eject roller 5, a cleaning unit 6, a carriage motor 7, and a platen 8. The carriage 2 is connected to part of the timing belt 3, which runs around a pulley attached to the shaft of the carriage motor 7 and another pulley diametrically opposed thereto. The timing belt 3 transfers a driving force from the carriage motor 7 to the carriage 2. The eject roller 5 is rotated slightly faster than the feed roller 4 so as to apply an appropriate tension to paper on the platen 8.

Figure 5:
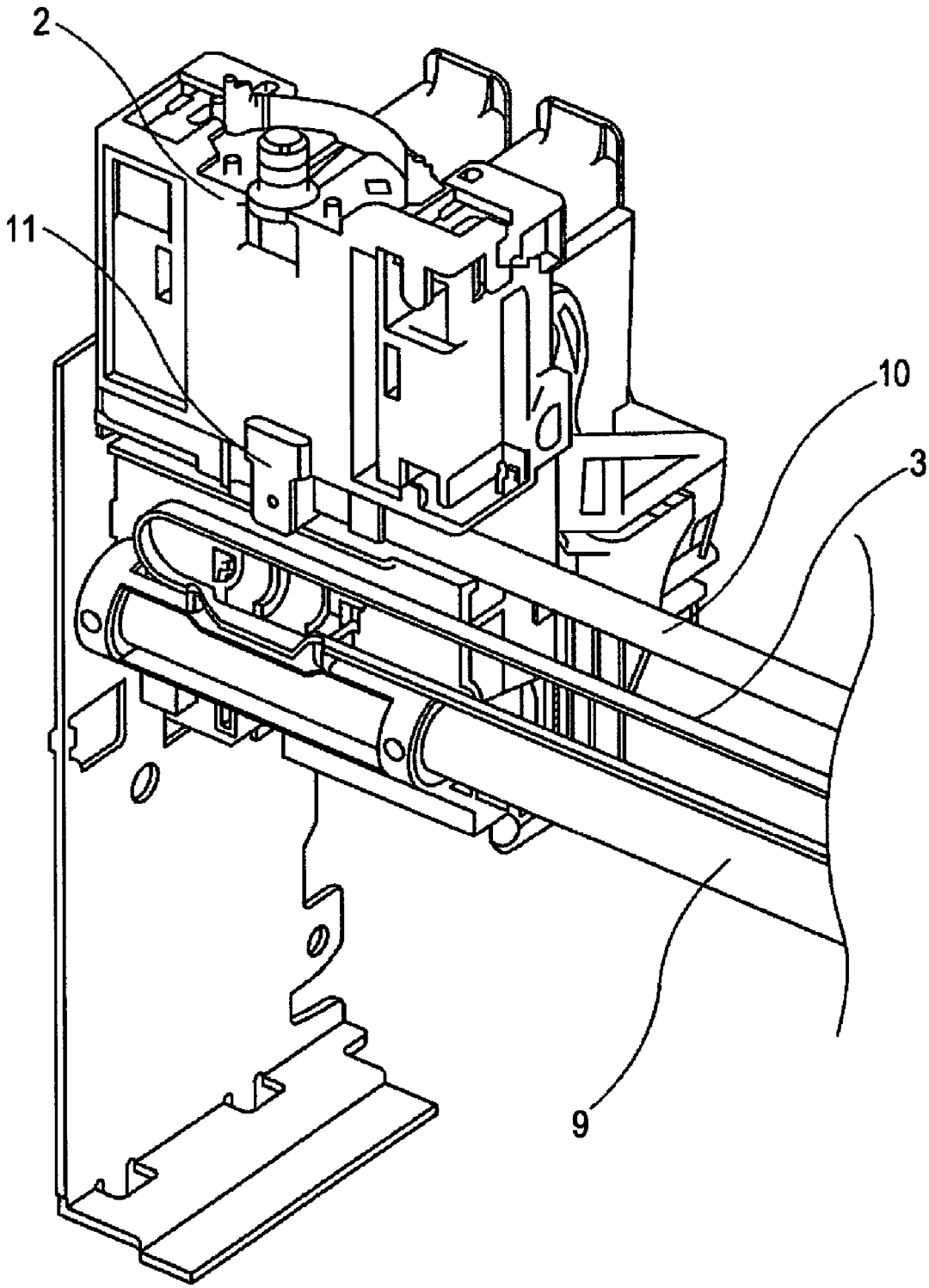
FIG. 5 is a back view of a carriage according to an exemplary embodiment of the present invention.

FIG. 5 illustrates the backside of the carriage 2 shown in FIG. 4. The carriage 2 is supported by a shaft 9 so as to be movable along the shaft 9. An encoder 11 disposed on the back surface of the carriage 2 reads a scaler 10 extending along the printer 1 as the carriage 2 moves. The printer 1 monitors the displacement of the carriage 2 and performs the feedback control of the carriage motor 7 according to information on the carriage displacement. The positional information supplied from the encoder 11 is also used to generate information on the timing for driving a print head.

Figure 6:
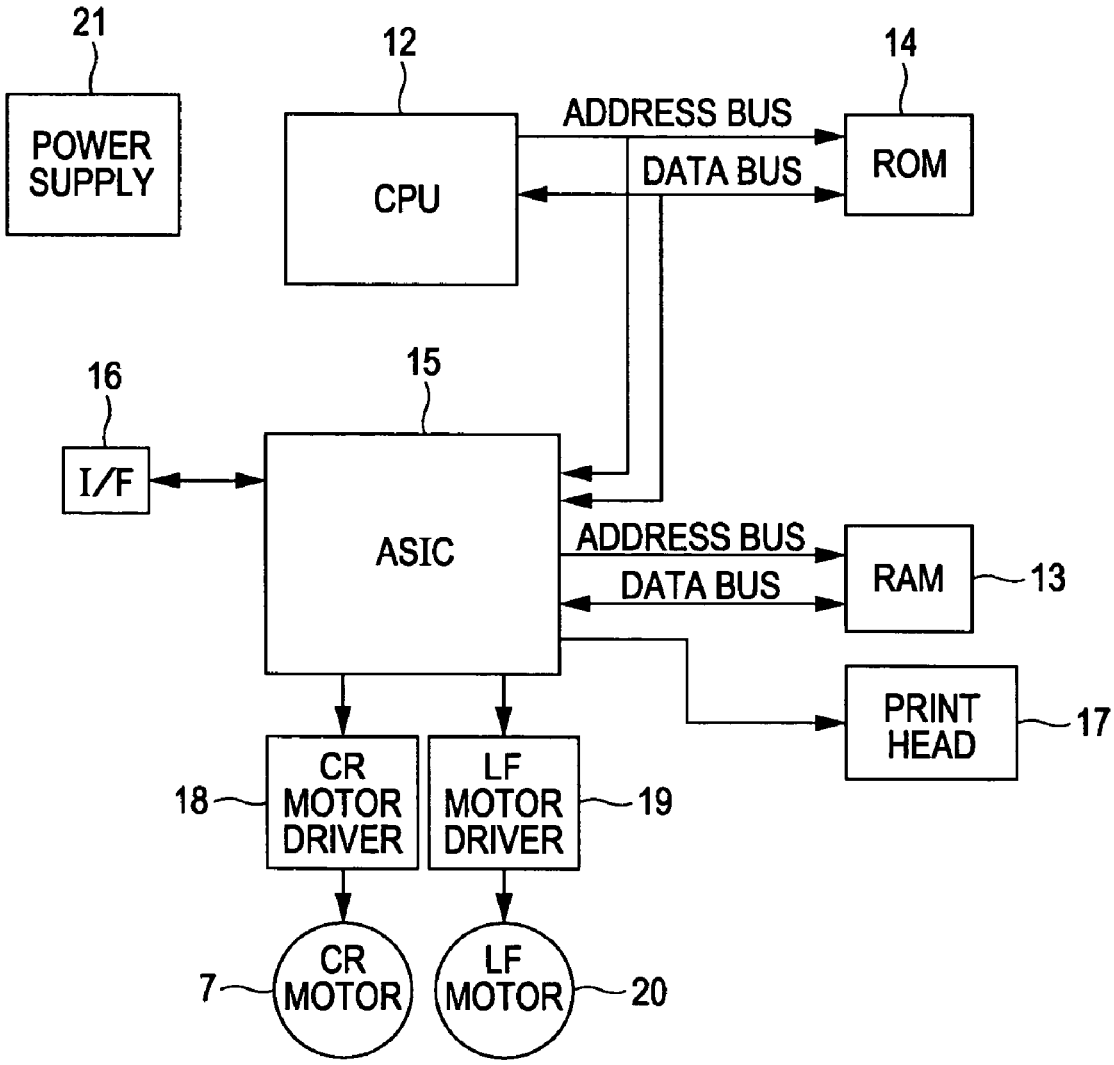
FIG. 6 is a block diagram of a configuration of an electronic circuit of the recording apparatus according to an exemplary embodiment of the present invention.

FIG. 6 illustrates an overall configuration of an electronic circuit of the printer 1 according to an exemplary embodiment of the present invention. The electronic circuit generally includes a processor (CPU) 12, a RAM 13, a ROM 14, and an ASIC 15. Although the individual elements are illustrated as separate components in FIG. 6, two or more of the illustrated elements may be integrated into a single component package, such as, for example, an LSI package. The ROM 14 stores, for example, printer firmware and a motor drive table in its OS and program region.

The ASIC 15 has the functions of, for example, motor drive control, image processing, communication with a host computer (host device) via an interface 16, and the ink ejection control of a print head 17 (also referred to herein as a "recording head"). The RAM 13 includes a receive buffer for temporarily storing data received from the host computer, a temporary memory (temporary buffer) for use in image processing, a print buffer for storing recording data, and a work buffer for storing a motor drive table.

FIG. 14 illustrates the data structure of the print buffer (also referred to herein as "recording buffer") and the recording data (printing data) stored therein according to an exemplary embodiment of the present invention. In FIG. 14, the upper-left address is the initial address of the print buffer, and the lower-right address is the final address of the print buffer. If, for example, recording is performed over a length of up to about 8 inches in a scanning direction for each scanning operation with data blocks that are each equivalent to a length of up to about 1 inch in the scanning direction, an image corresponding to each scanning operation is completed by recording eight data blocks in total. In other words, the data structure of the print buffer in FIG. 14 corresponds to recording positions on a recording medium for each scanning operation.

First to eighth blocks of the print buffer in FIG. 14 are arranged in the scanning direction of the print head 17 and are stored in that order. Each of the blocks includes first to eighth color data. If there is no data to be recorded for one color, no buffer region is assigned to the color. If, for example, the first block does not include eighth color data, no region is assigned to the eighth color. In this case, the region following the region where the seventh color data of the first block is stored is assigned to the first color data of the second block.

The length of each color data stored in each block corresponds to the number of nozzles of the print head 17.

The print head 17 starts recording by scanning after the eighth data block is stored. If the recording data is processed at high speed, the recording may be started after the fifth block, for example, is stored.

The printer 1 further includes a carriage (CR) motor driver 18 and a feed (LF) motor driver 19. The CR motor driver 18 is coupled to a CR motor 7. The LF motor driver 19 is coupled to an LF motor 20. The combination of motors and motor drivers illustrated in FIG. 6 is merely an example, and the printer 1 may include any number of motors and motor drivers.

A power supply 21 is connectable to a commercial power supply to serve as a power supply to the printer 1, for example, for driving semiconductor devices, a motor drive power supply, and a head drive power supply.

Figure 2:
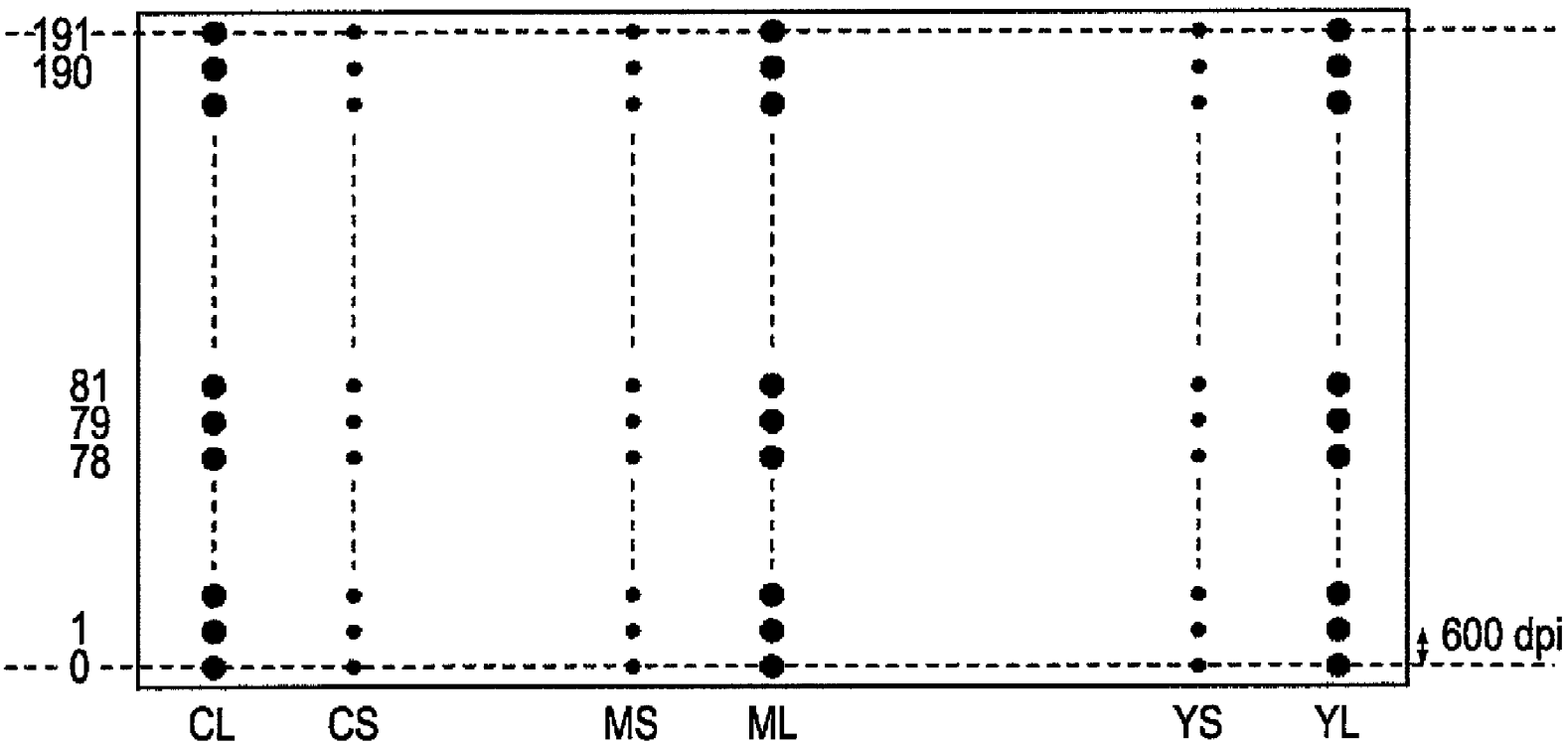
(PRIOR ART) FIG. 2
FIG. 2 is a diagram illustrating an arrangement of color nozzle arrays according to an exemplary embodiment of the present invention.

In an exemplary embodiment, the print head 17 has nozzle arrays (recording element arrays) extending in the column direction as shown in FIG. 2. Each of the nozzle arrays is divided into nozzle blocks that are driven at different timings.

As shown in FIG. 3, each of the nozzle blocks includes 12 nozzles separated at intervals of 16 nozzles. Thus, nozzles separated at intervals of a predetermined number of nozzles are grouped into the same block so that the adjacent nozzles can be driven with a reduced effect on each other.

Figure 7:
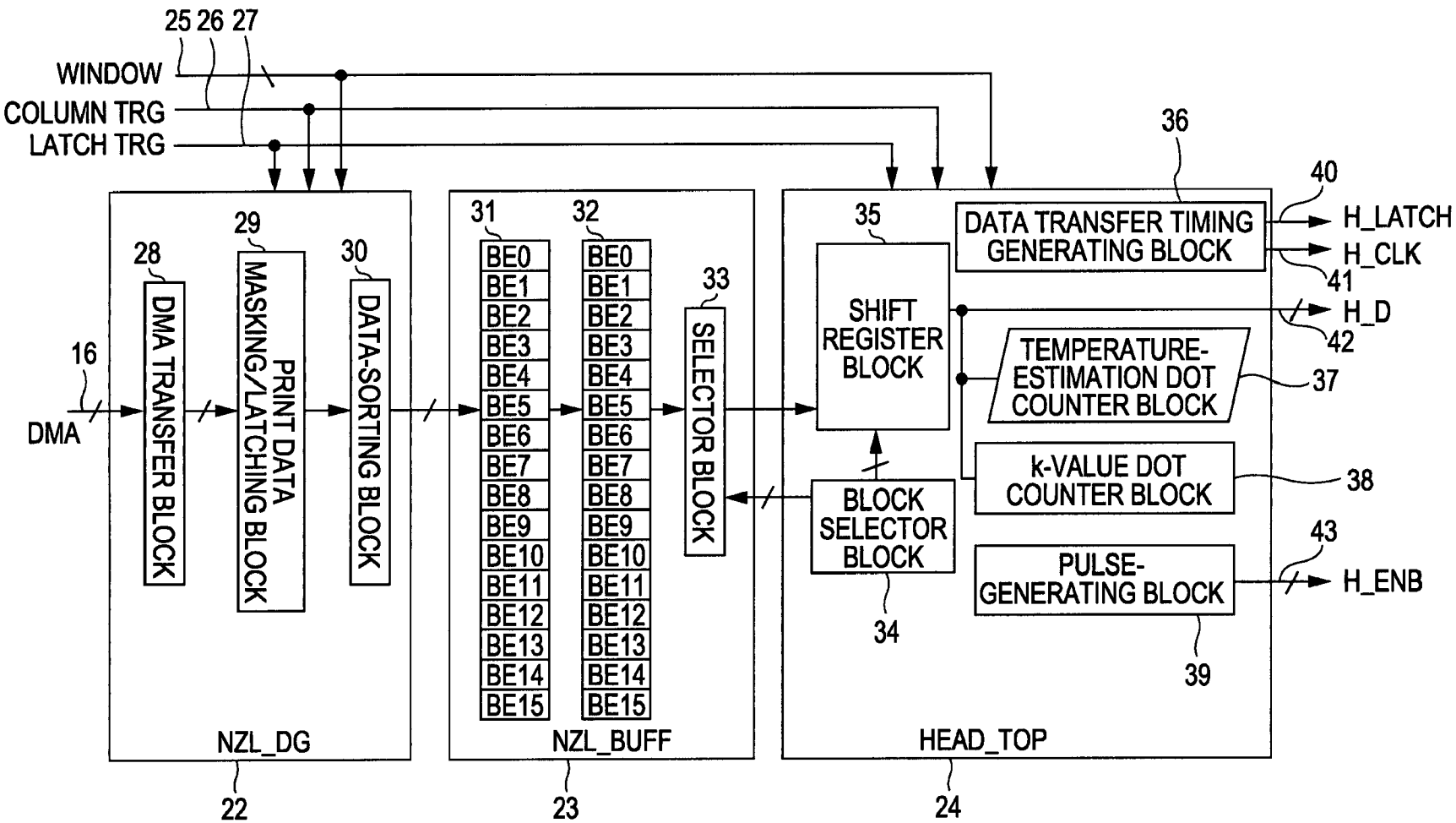
FIG. 7 is a block diagram of a control block for driving a print head according to an exemplary embodiment of the present invention.

Next, a control block for driving the print head 17 is described below. FIG. 7 illustrates a block diagram of the control block for driving the print head 17, according to an exemplary embodiment of the present invention. The control block shown in FIG. 7 may be incorporated within the ASIC 15 in FIG. 6.

In FIG. 7, the control block generally includes three sub-blocks: a nozzle data-generating block (NZL_DG) 22 for generating nozzle data, a nozzle data-retaining block (NZL_BUFF) 23 for retaining the nozzle data, and a print head control block (HEAD_TOP) 24. The nozzle data-generating block 22 and the print head control block 24 are started with print timing signals including window signals 25, column trigger (TRG) signals 26, and latch TRG signals 27 as reference timing signals. These print timing signals are fed by a timing-generating block (not shown) based on positional information supplied from the encoder 11.

Figure 1:
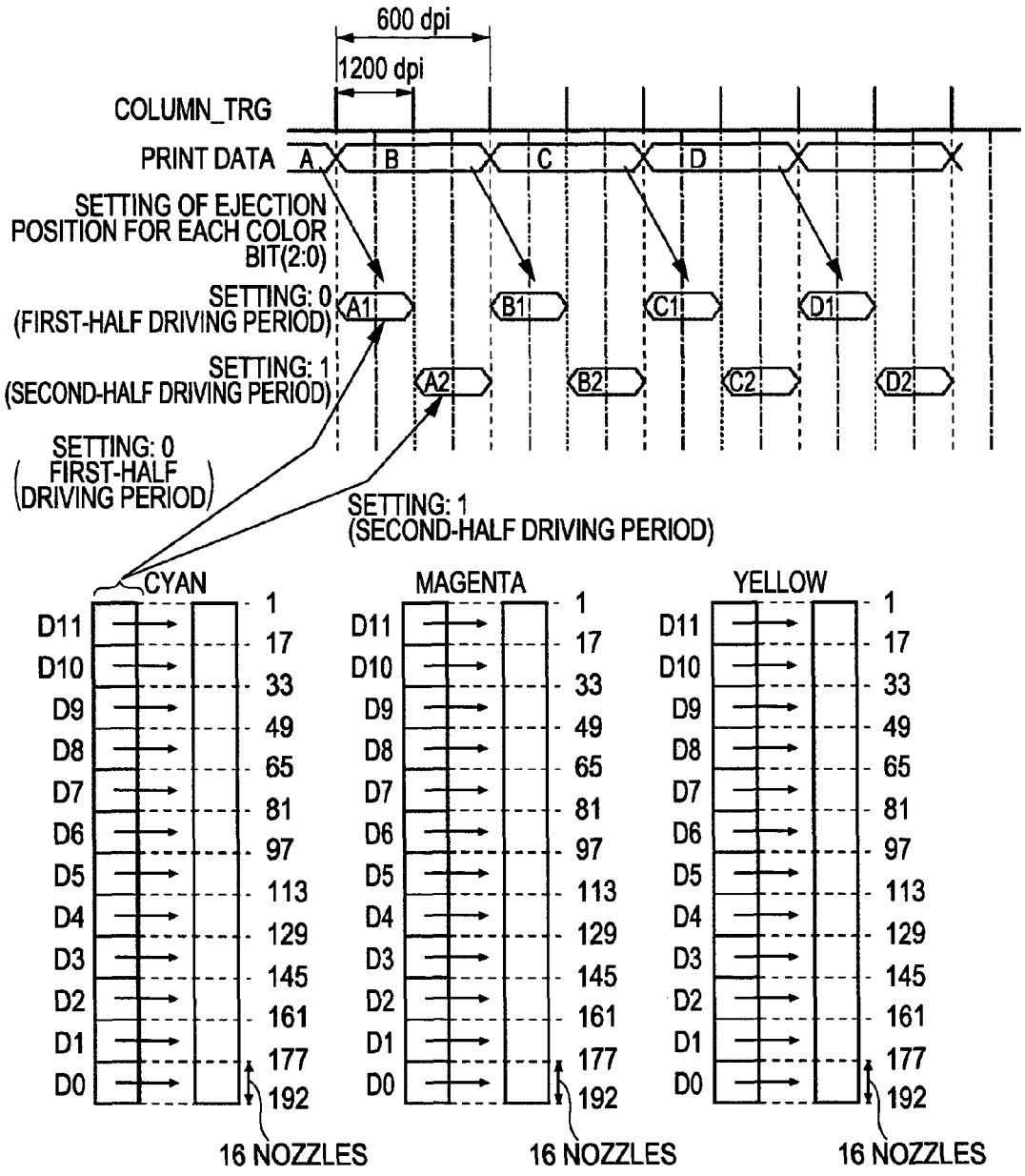
FIG. 1 is a diagram for illustrating embodiments of the present invention.

Specifically, the window signals 25 set a flag (window open) to start printing when the carriage 2 moves in the scanning direction to reach a designated print position (the position where printing is started) and clear the flag (window closed) when the carriage 2 reaches the ending position of the printing. The number of the window signals 25 corresponds to the number of nozzle arrays of the print head 17. For example, two nozzle arrays, odd and even, are provided for black color, and six nozzle arrays are provided for the other colors. In FIG. 1, for example, the six nozzle arrays include a cyan large nozzle array CL, a cyan small nozzle array CS, a magenta large nozzle array ML, a magenta small nozzle array MS, a yellow large nozzle array YL, and a yellow small nozzle array YS. If the large and small nozzle arrays cannot be simultaneously driven, they are driven with common window signals. That is, in an exemplary embodiment, the print head 17 is controlled with five window signals in total, two for the black nozzle arrays and three for the color nozzle arrays.

The column TRG signals 26 are fed at intervals of a column. The intervals of the column TRG signals 26 determine print resolution in a raster direction, that is, in a main scanning direction. The latch TRG signals 27 are fed at timings defined by uniformly dividing an interval of a column by the number of blocks to provide switch timings for time-division driving. If each column is divided into 16 blocks as in this embodiment, 16 latch TRG signals 27 are fed within an interval of a column.

The nozzle data-generating block 22 includes a direct memory access (DMA) transfer block 28, a print data masking/latching block 29, and a data-sorting block 30. The DMA transfer block 28 retrieves print data from the print buffer of the RAM 13 by DMA transfer. If all nozzles of a color nozzle array shown in FIG. 2 are used, the amount of data retrieved is 16 (bits) multiplied by 12 (the number of times of DMA) to equal 192 (bits). The number of times of DMA depends on the number of nozzles used. The nozzle data-generating block 22 counts the number of the column TRG signals 26 received. The DMA transfer block 28 operates to read one column of data from the print buffer each time two column TRG signals 26 are received.

The print data masking/latching block 29 functions to latch the data retrieved by the DMA transfer of the DMA transfer block 28 for each nozzle position and mask unused nozzles according to register information (not shown). The nozzle masking can be set for each nozzle. The data-sorting block 30 sorts the data according to the blocks of the print head 17. That is, the data-sorting block 30 sorts print data into nozzle block data sequences according to information on the blocks shown in the table of FIG. 3.

The nozzle data-generating block 22 is typically started by the combination of the window signals 25 and the column TRG signals 26. That is, the window signals 25 set a flag when the print head 17 reaches the designated print position, and the column TRG signals 26 then allow the printer 1 to start retrieving print data. The printer 1 stops retrieving print data when the window signals 25 indicate that window is closed (i.e., when the carriage 2 reaches the end position of the printing).

The nozzle data-retaining block 23, called a nozzle buffer (NZL_BUFF), retains nozzle data having the block structure shown in the table of FIG. 3. The arrangement of the nozzle data coincides with the nozzle arrangement of the blocks of the print head 17. This facilitates data management and the generation of print data. This nozzle buffer shown in FIG. 7 has a double structure including a first buffer 31 and a second buffer 32. The two buffers 31 and 32 each retain a column of data for every nozzle array. The amount of data retained is 10 (bits) multiplied by 16 (blocks) to equal 160 (bits) for each black nozzle array and is 12 (bits) multiplied by 16 (blocks) to equal 192 (bits) for each color nozzle array. The double structure allows the nozzle buffer to transfer a column of block data to the print head 17 while preparing for the next column of block data. In an exemplary embodiment, the first buffer 31 is used for writing while the second buffer 32 is used for reading. A selector block 33 sequentially selects the blocks and outputs nozzle data for each block according to selection signals supplied from a block selector block 34 of the print head control block 24. The bus width for nozzle data is 16 bits. For the color nozzle arrays, nozzle data is assigned to all 16 bits. For the black nozzle arrays, the data "0" is assigned to the top 2 bits because black nozzle data has only 10 bits. Thus, the bus width for nozzle data is uniform so that the circuitry of the print head control block 24 can be shared among the nozzle arrays of different colors.

The print head control block 24 includes the block selector block 34, a shift register block 35, a timing-generating block 36 for generating data transfer timings, a temperature-estimation dot counter block 37, a k-value dot counter block 38, and a pulse-generating block 39. The print head control block 24 outputs print head drive signals, namely, latch (H_LATCH) signals 40, transfer clock (H_CLK) signals 41, print head drive data (H_D) signals 42, and heat-enable (H_ENB) signals 43. The print head control block 24 is started by the window signals 25, the column TRG signals 26, and the latch TRG signals 27.

The block selector block 34 outputs block selection signals to the selector block 33 of the nozzle data-retaining block 23 in an appropriate order of blocks according to the latch TRG signals 27 for time-division driving. The block selector block 34 simultaneously outputs the block selection signals to the shift register block 35.

The shift register block 35 converts the nozzle data output by the nozzle data-retaining block 23 and the block selection signals into serial data to output the data as the H_D signals 42. The shift register block 35 has the function of setting null data. This function generates H_D signals 42 including null data according to block information and drive sequence selection information. Instead of print data, null data is assigned to, for example, a bit D11 corresponding to nozzles 1 to 16. The assignment of null data can stop ink ejection for each group despite the operation of a drive sequence. This function can be set independently of the selection of a first-half driving period or a second-half driving period by selecting a drive sequence. The H_D signals 42 include five series of signals in total, two for the even and odd black nozzle arrays and three for the large and small color nozzle arrays, which share data signals.

Using the latch TRG signals 27 as reference signals, the timing-generating block 36 generates the H_CLK signals 41 to transfer the H_D signals 42, generates the H_LATCH signals 40 to latch data stored in a shift register in the print head 17, and feeds data shift timings to the shift register block 35.

The pulse-generating block 39 generates the H_ENB signals 43. The temperature-estimation dot counter block 37 and the k-value dot counter block 38 are arithmetic blocks for correcting the drive pulse width of the H_ENB signals 43 according to the frequency of ejection from the nozzles. The temperature-estimation dot counter block 37 is used to change a correction table in increments of tens of milliseconds. The k-value dot counter block 38, using the H_LATCH signals 40 as reference signals, determines the optimum heat pulse width for each block according to the extent of temperature rise in the previous block to control the amount of ink ejected in the next block (hereinafter referred to as k-value control). The extent of temperature rise depends on the frequency of ejection from the nozzles.

The H_ENB signals 43 include one series of signals for the black nozzle arrays and two series of signals for the color nozzle arrays. The color nozzle arrays are fed with two series of signals so that the timing for heating can be shifted to distribute the energy required for ejection.

Figure 8:
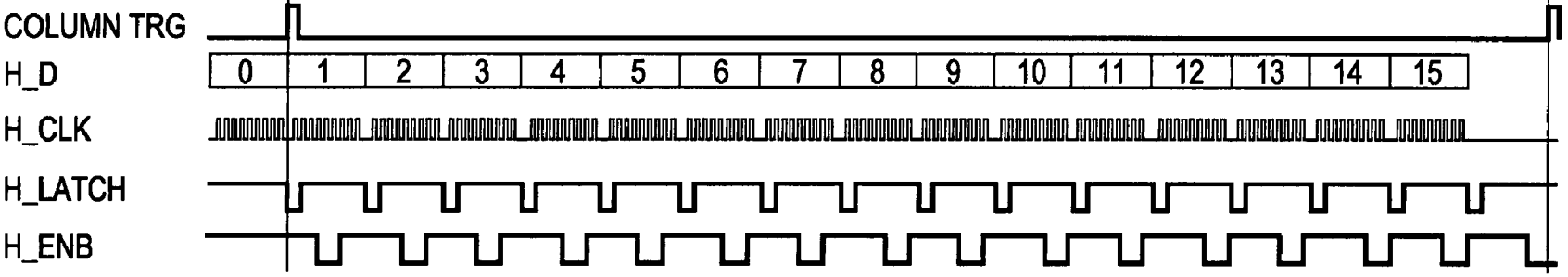
FIG. 8 is a diagram illustrating timings for driving a recording head for each column.
Figure 11:
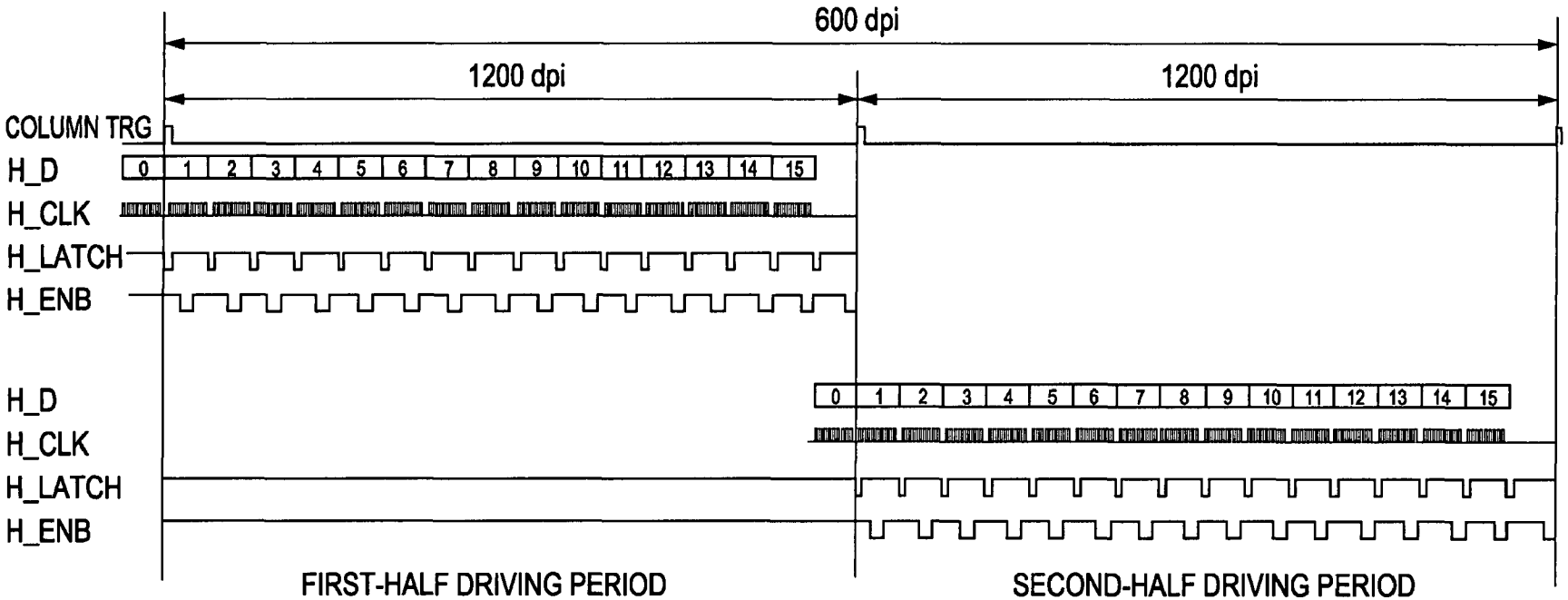
FIG. 11 is a diagram illustrating timings for driving the recording head in first-half and second-half driving periods according to an exemplary embodiment of the present invention.

Drive timings previously used are described in reference to FIG. 8 before the description of drive timings, according to an exemplary embodiment, shown in FIG. 11. More specifically, FIG. 8 shows timings previously used for driving the print head 17 for each column. The column TRG signals 26 are output at intervals of 600 dpi. The column TRG signals 26 are internal signals while the H_LATCH signals 40, the H_CLK signals 41, the H_D signals 42, and the H_ENB signals 43 are print head drive signals. In FIG. 8, each column includes 16 blocks that are driven by time division. The H_D signals 42 are transferred to the shift register in the print head 17 according to the H_CLK signals 41 and are latched when the H_LATCH signals 40 are turned off.

The H_ENB signals 43 follow the H_LATCH signals 40 to induce ink ejection according to the data latched by the H_LATCH signals 40. The H_ENB signals 43 are generated while data for the next block is transferred. The data for the next block is latched by the H_LATCH signals 40 following the H_ENB signals 43. The process of transferring data, latching the data, and driving the head is repeated for 16 blocks. While the drive timings are as described above, the column TRG signals 26 are output at intervals of 1,200 dpi in the embodiments of the present invention, as shown in FIG. 11. The timings for transferring data, latching the data, and driving the head are similar to those in FIG. 8.

Figure 9:
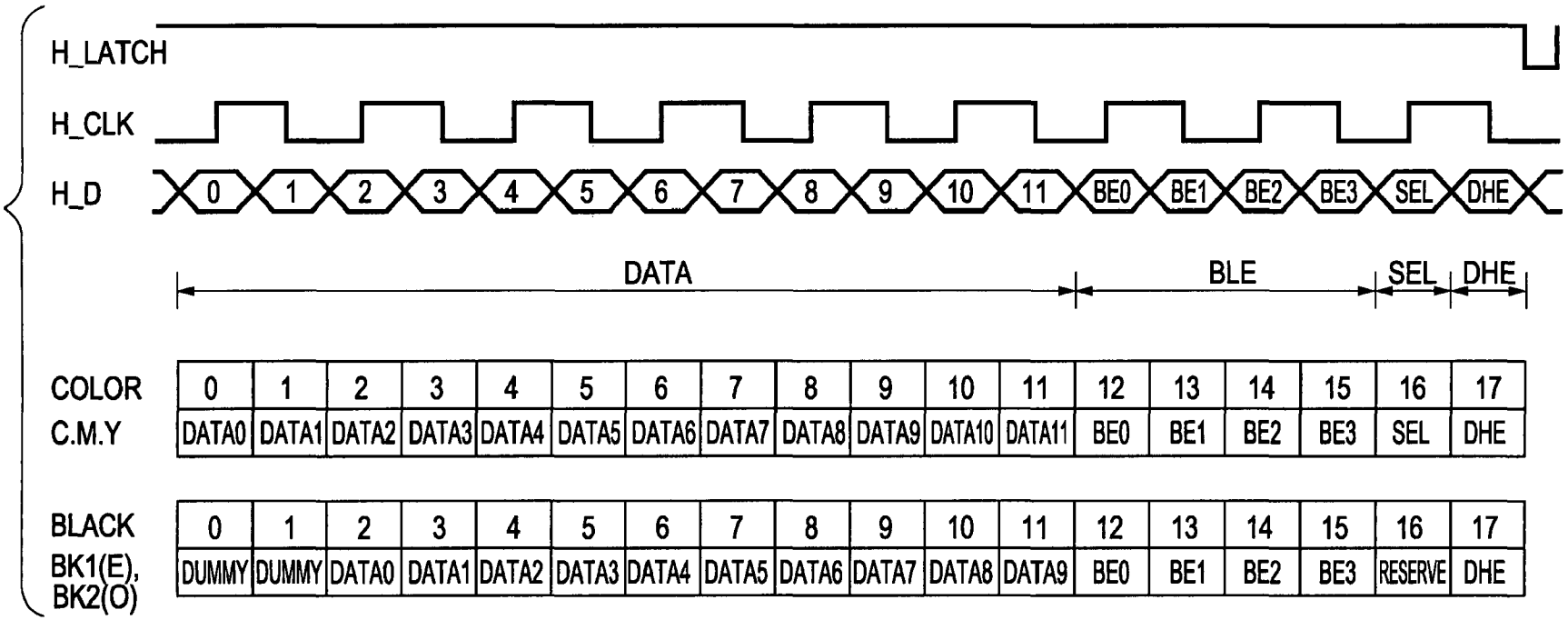
FIG. 9 is a diagram illustrating timings for transferring data to a recording head.

FIG. 9 shows the relationship between the H_CLK signals 41 and the H_D signals 42. The H_D signals 42 are fed at the edges of the H_CLK signals 41 to reduce the time for transfer. The frequency used for the H_CLK signals 41 is about 6 to 12 MHz. In the data structure of the H_D signals 42, bits 0 to 11 are nozzle data. The bits 2 to 11, 10 bits in total, are nozzle data for the black nozzle arrays while the bits 0 to 11, 12 bits in total, are nozzle data for the color nozzle arrays. Bits 12 to 15, 4 bits in total, are block selection data BLE which is used to select the block to be driven in the print head 17, thus achieving time-division driving.

A bit 16 is heater-switching data SEL for selecting the large or small color nozzle arrays. The large nozzle arrays eject about 5 pl of ink while the small nozzle arrays eject about 2 pl of ink. A bit 17 is dummy nozzle selection data DHE. If the bit 17 is enabled, ejection can be performed from several dummy nozzles disposed at the front and rear ends of the nozzle arrays. These dummy nozzles are provided to discharge ink remaining at the corners of ink chambers in the preliminary ejection of the print head 17.

FIG. 11 shows timings for driving the print head 17 in first-half and second-half driving periods according to an exemplary embodiment of the present invention. More specifically, the timing in FIG. 11 shows when the nozzle data-generating block 22 generates nozzle data and when the first buffer 31 of the nozzle data-retaining block 23 latches the nozzle data. The timing in FIG. 11 also shows when the print head control block 24 executes ejection according to the nozzle data retained in the second buffer 32.

The print data stored in the print buffer has a resolution of 600 dpi. When the print head 17 is driven, the nozzle data-generating block 22 reads image data from the print buffer in units of two column timings. Because the interval for each column is 1,200 dpi, the nozzle data-generating block 22 updates nozzle data at intervals of 600 dpi, which agrees with the resolution of the image data stored in the print buffer.

The print head control block 24 has the function of selecting either the first-half driving period or the second-half driving period for two continuous column timings. Thus, in FIG. 1, print data A is printed at a timing A1 or a timing A2. FIG. 11 shows ejection at the timing A1 or the timing A2. Data B to D is similarly processed. This method allows printing at a resolution higher than that of recording image data.

This selection function has two approaches. One is the setting of print head drive data to either the first-half driving period or the second-half driving period for two continuous column timings, as shown in FIG. 11. If, for example, the first-half driving period is selected for the bit D11, the null data setting function of the shift register block 35 is operated for the second-half driving period. Accordingly, recording is performed by ink ejection according to recording data in the first-half driving period while recording is prohibited and not performed because of null data in the second-half driving period. The selection function thus allows the setting of ink ejection at a selected drive timing and the prohibition of ink ejection at a non-selected drive timing.

Figure 15A:
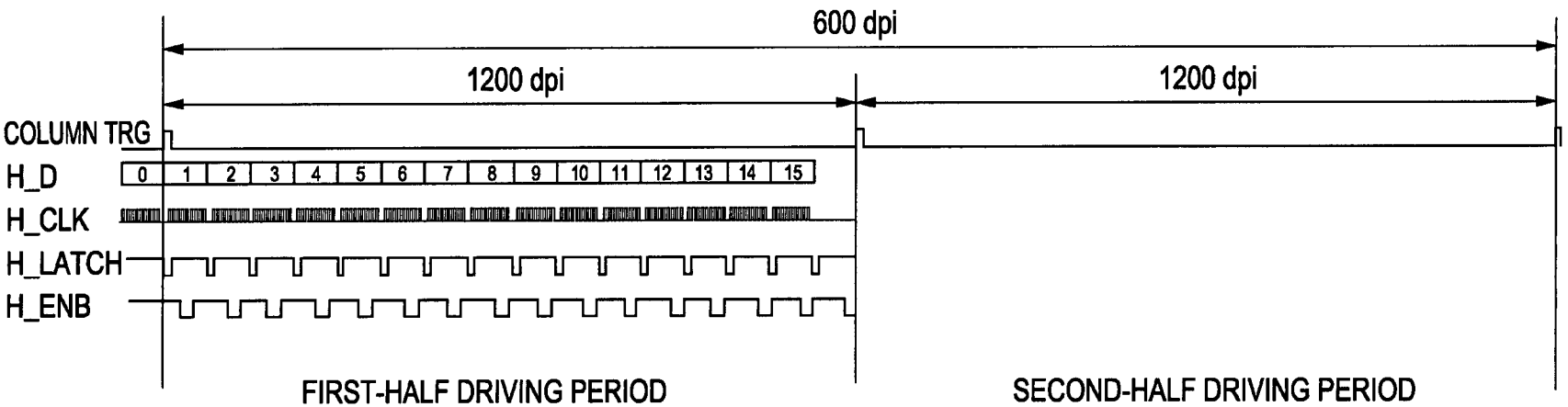
FIGS. 15A and 15B are diagrams illustrating timings for driving the recording head in the first-half driving period and the second-half driving period, respectively, in accordance with an exemplary embodiment of the present invention.
Figure 15B:
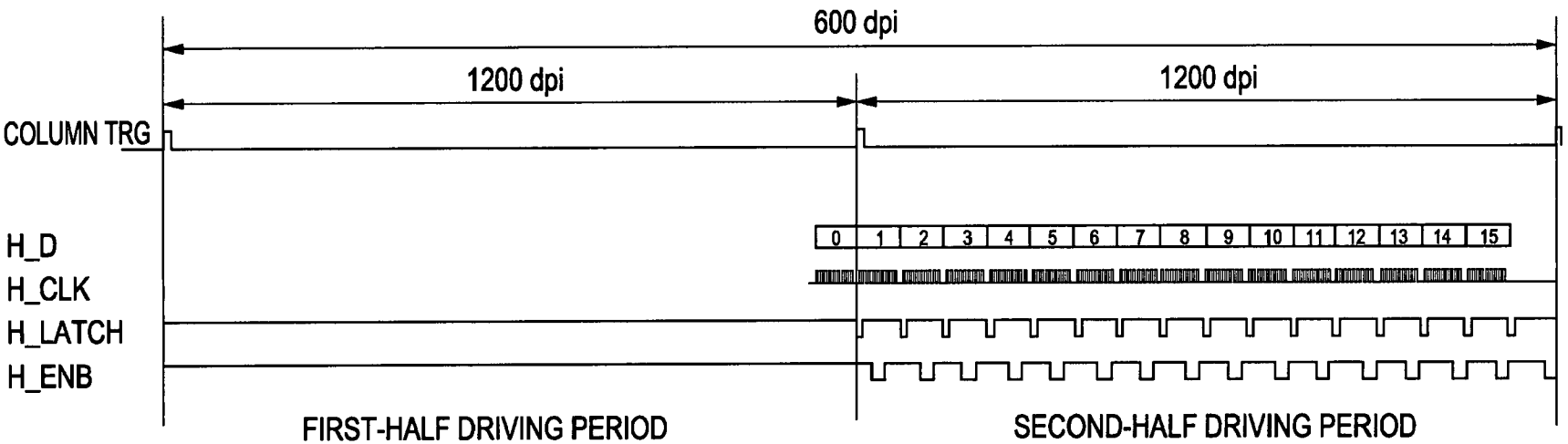

The other approach is the setting of either the first-half driving period, as shown in FIG. 15A, or the second-half driving period, as shown in FIG. 15B, for two continuous column timings. Ink ejection according to recording data may be performed in either the first-half driving period or the second-half driving period. In this case, the shift register block 35 does not have to set null data.

First Exemplary Embodiment

Figure 12A:
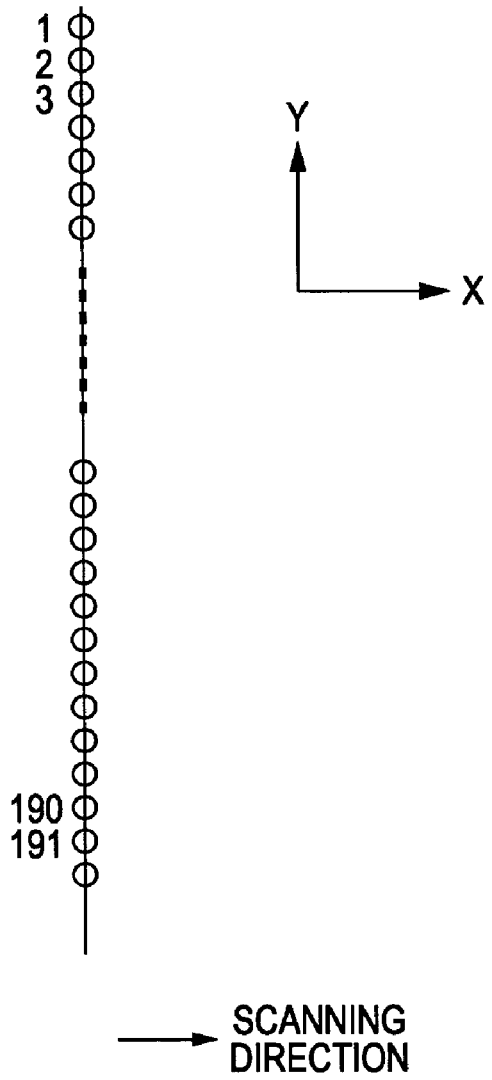
FIGS. 12A and 12B are diagrams illustrating an example of a nozzle misalignment.
Figure 12B:
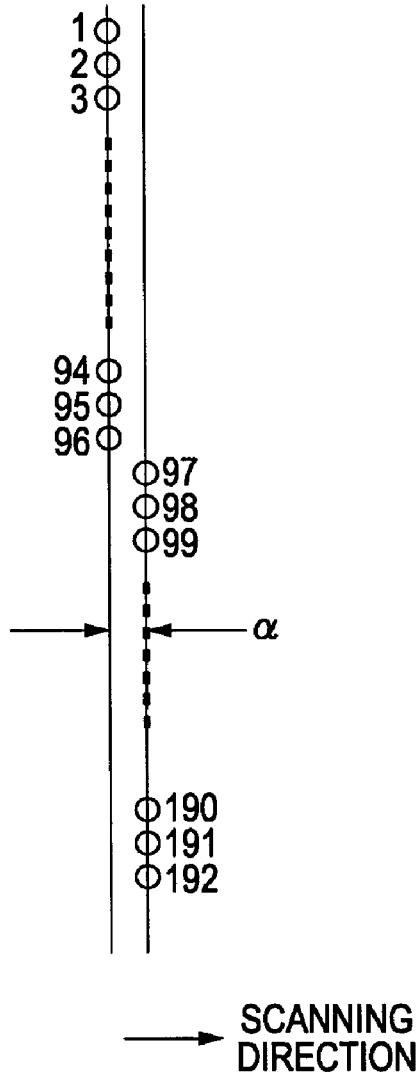

The timing for driving a print head is described below with reference to FIG. 1. Referring to FIGS. 12A and 12B, an example of a misalignment (also referred to herein as "inclination") of nozzles within a nozzle array is illustrated to facilitate a thorough understanding of exemplary embodiments of the present invention. Specifically, FIG. 12A illustrates the nozzle arrangement of an exemplary color nozzle array, including 192 nozzles, of a color print head. When the print head having the nozzle array shown in FIG. 12A is fitted and fixed to a carriage, a misalignment can occur in the x-axis direction, as shown in FIG. 12B. The x-axis direction is the scanning (movement) direction of the print head in a recording apparatus. The y-axis direction is the direction in which a recording medium (recording paper) is conveyed in the recording apparatus.

Such a misalignment within a single nozzle array can also be caused by variations in manufacturing. In FIG. 12B, for example, nozzles 97 to 192 are misaligned from nozzles 1 to 96 within the same nozzle array by a slight distance $\alpha$. Although the misalignment in the x-axis direction is illustrated in FIG. 12B for convenience of description, misalignments in inclined directions are also assumed in accordance with an aspect of the present invention.

Each of nozzle arrays of different colors has nozzle groups, each including 16 nozzles. For example, the color nozzle array including 192 nozzles in FIG. 1 has 12 nozzle groups. In an exemplary embodiment, the bits of a register are assigned to the nozzle groups as follows. A bit D0 is assigned to nozzles 177 to 192. A bit D1 is assigned to nozzles 161 to 176. The other bits D2 to D11 are assigned to the corresponding nozzle groups. The bit D11 is assigned to the nozzles 1 to 16.

The function of the register is enabled or disabled by an enable register (not shown). The nozzle 1 of the print head is positioned downstream in the direction in which paper is ejected.

If any bit is set to "0" with the enable register being enabled, the corresponding group ejects ink according to 600 dpi print data in the first-half driving period at 1,200 dpi. If the bit is set to "1", the group ejects ink in the second-half driving period at 1,200 dpi.

For the misalignment of the color nozzle array in FIG. 12B, for example, the bits D11 to D6 are set to "0" to drive the nozzles 1 to 96 in the first-half driving period at 1,200 dpi, and the bits D5 to D0 are set to "1" to drive the nozzles 97 to 192 in the second-half driving period at 1,200 dpi. These settings are based on information on the inclination of the nozzle array of the recording head.

Thus, a misalignment of nozzles within a nozzle array can be corrected by providing a time difference in the timing for driving (ejection).

That is, a misalignment can be corrected by selecting an appropriate timing from a plurality of drive start timings provided within a period corresponding to 600 dpi (the intervals for the drive start timings are 1,200 dpi).

In other words, the settings are made so that each nozzle group is driven at a first drive step (in the first-half driving period) or a second drive step (in the second-half driving period). The first and second drive steps each have a period (1,200 dpi) shorter than a predetermined period (600 dpi).

In the example described above, the timing for ejection from the nozzles 97 to 192 may be delayed because they are misaligned from a reference nozzle array position to the downstream side in the scanning direction. This method allows the control of the timing for ejection in units of 1,200 dpi, which is higher than the resolution of print data, namely, 600 dpi, so that a misalignment can be corrected only by controlling the timing for ejection irrespective of print data.

Second Exemplary Embodiment

In a second embodiment, the positions of nozzles within a nozzle array are locally corrected by controlling (shifting) the timing for reading recording data (print data) for each nozzle group in addition to the timing control for driving the print head described in the first embodiment. The control described below is based on information on the inclination of the nozzles of the nozzle array.

Figure 10:
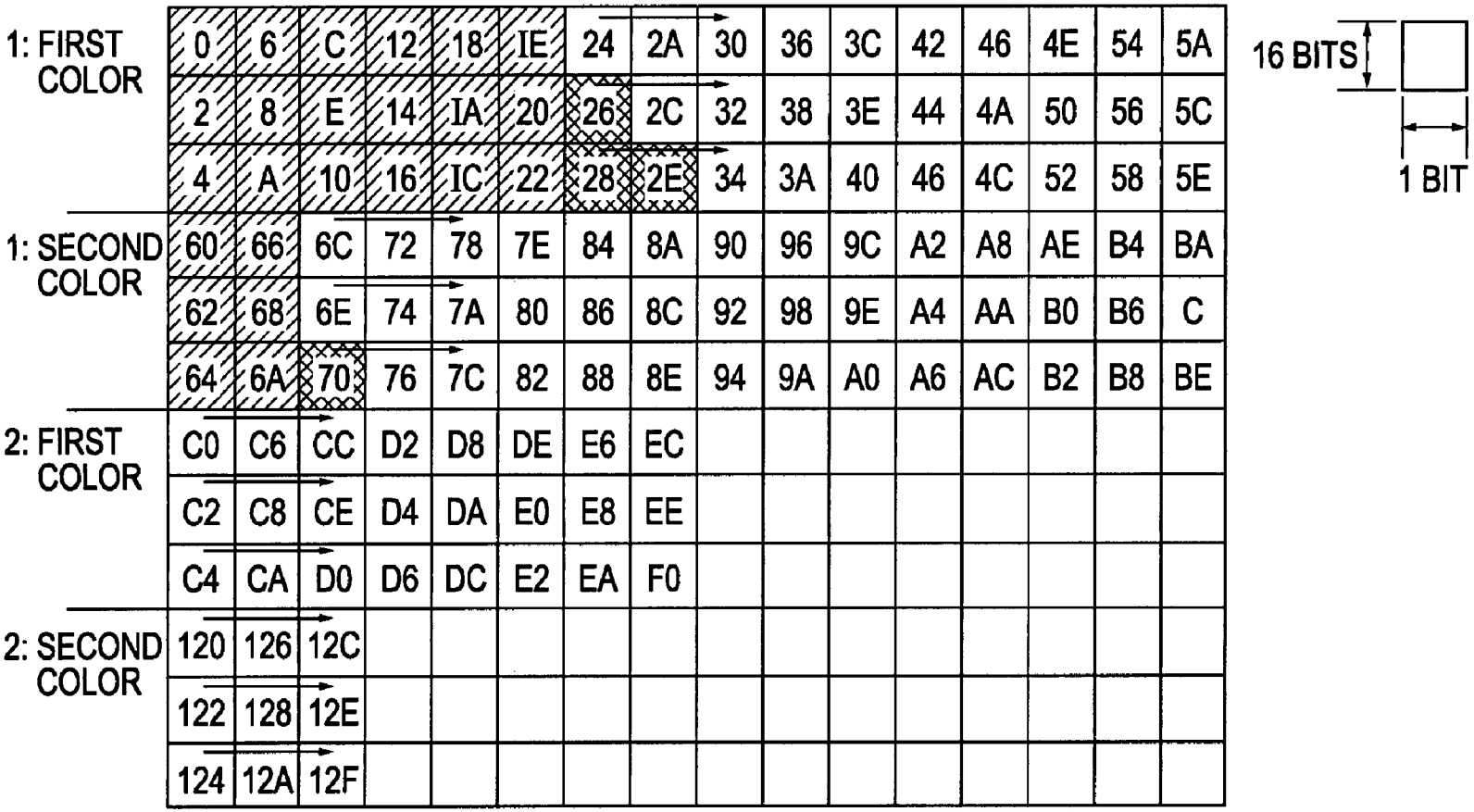
FIG. 10 is a diagram illustrating an example of a recording buffer storing recording data according to misalignment (inclination) of nozzle arrays.

FIG. 10 is a diagram illustrating an example of a recording buffer (print buffer) storing recording data (printing data)

according to the inclination of nozzle arrays. In FIG. 10, the nozzle arrays each have three nozzle groups (each including 16 nozzles). The horizontal direction of addresses in FIG. 10 corresponds to the scanning direction of a print head. Each address corresponds to one group and stores a column of recording data.

A first color nozzle array, for example, is assumed to have a column of misalignment between first and second groups (inclination correction value=1) and a column of misalignment between second and third groups. That is, the third group is misaligned with respect to the first group by two columns (inclination correction value=2).

The data corresponding to the individual groups is therefore stored in the recording buffer (print buffer) such that the data is shifted in units of a column. In FIG. 10, the timing for reading the data for the second group is delayed with respect to the timing for reading the data for the first group by one column.

The data corresponding to the first group is sequentially stored at addresses 24, 2A, 30, and the subsequent addresses. The data corresponding to the second group is sequentially stored at addresses 2C, 32, 38, and the subsequent addresses. The data corresponding to the third group is sequentially stored at addresses 34, 3A, 40, and the subsequent addresses.

The recording data for a second color may be stored in a similar manner. A second color nozzle array is assumed to have no misalignment between first and second groups (inclination correction value=0) and a column of misalignment between the first and second groups and the third group. Accordingly, the position of the initial address for the data corresponding to the first group is equal to that of the initial address for the data corresponding to the second group in the scanning direction.

The timing for reading data may also be advanced by shifting the position where recording data is stored. In FIG. 10, for example, the data for the second group may be stored from the address 20 to advance the timing for reading the data for the second group with respect to the timing for reading the data for the first group by one column.

Figure 13:
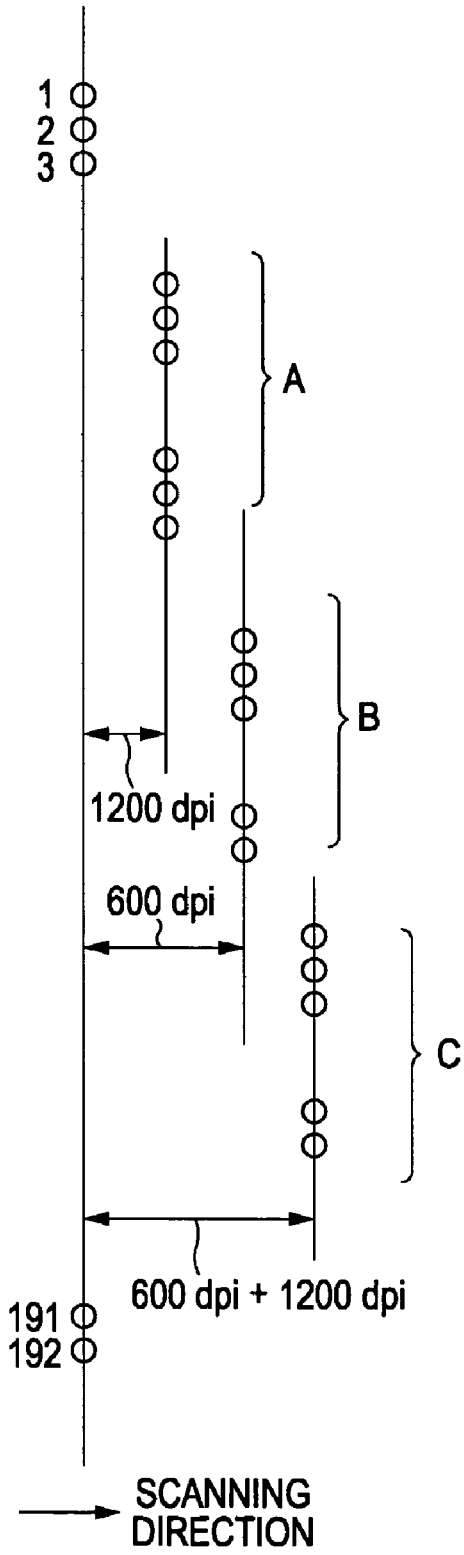
FIG. 13 is a diagram illustrating another example of a nozzle misalignment.

FIG. 13 illustrates an example of a nozzle array with a three-step misalignment. The arrow shown in FIG. 13 indicates the scanning direction of a print head.

A region A has a misalignment of about 1,200 dpi in terms of resolution with respect to a reference nozzle array position in the scanning direction. This misalignment can be corrected by recording 600 dpi print data in the second-half driving period at 1,200 dpi. Nozzles (1, 2, 3, 191, and 192) aligned at the reference nozzle array position eject ink in the first-half driving period at 1,200 dpi because they need no correction.

A region B has a misalignment of about 600 dpi in terms of resolution with respect to the reference nozzle array position. This misalignment can be corrected by advancing the timing for reading the print data by one pixel (600 dpi) because the print data has a resolution of 600 dpi. The nozzles in the region B are driven in the first-half driving period at 1,200 dpi because the nozzles are preferably calibrated to coincide in the timing for ejection in the nozzle array, which is driven in the first-half and second-half driving periods at 1,200 dpi for correction.

A region C has a misalignment of about 600 dpi plus 1,200 dpi in terms of resolution with respect to the reference nozzle array position. This misalignment can be corrected by a combination of the shift of print data and the driving in the second-half driving period at 1,200 dpi. The correction is performed for each of the nozzle groups, including 16 nozzles, as in the first embodiment.

According to the second embodiment, as described above, variations in the positions of nozzles within a nozzle array can be corrected more exactly in units of a nozzle group including 16 nozzles by a combination of the shift of print data and ejection in the first-half or second-half driving period at intervals of 1,200 dpi.

Third Exemplary Embodiment

The driving of nozzles, which is controlled in units of 16 nozzles in the first and second embodiments, may also be controlled in units of 8 nozzles, as described in a third embodiment.

This embodiment allows registration according to the inclination of a nozzle array in the case where the writing (storage) of recording data in the recording buffer and the reading of the recording data from the recording buffer are performed in different manners.

A specific example is the case where recording data is stored in the recording buffer in units of 16 bits for each address while 16 bits of data is read from two addresses.

Such access to the recording buffer is executed if the distance over which recording paper is conveyed is not equivalent to an integral multiple of the number of nozzles in each block, namely, an integral multiple of 16 nozzles. For example, such conveyance of recording paper is performed for recording at the front or rear end of the paper.

If, for example, the region to be scanned by the recording head is not an end (front or rear) of recording paper, the paper is conveyed over a distance of 48 nozzles, and recording after conveyance is performed using 48 nozzles.

For recording at an end (front or rear) of recording paper, on the other hand, the paper is conveyed over a distance of 40 nozzles. After conveyance, null data is assigned to some nozzles (1st to 8th nozzles) and recording is performed using 9th to 48th nozzles. For example, data for the 1st nozzle is assigned to the 9th nozzle, and data for the 2nd nozzle is assigned to the 10th nozzle. Thus, the recording data assigned to the nozzles is shifted (offset) by 8 nozzles.

The CPU 12 or the ASIC 15 shown in FIG. 6, for example, controls the change of the unit for drive control according to the distance over which recording paper is conveyed.

In the first and second embodiments, a misalignment may not be corrected if the recording data assigned to nozzles is shifted. In this embodiment, a misalignment can be corrected by adapting the unit for drive control according to the amount of shift (offset).

The unit for drive control is not limited to 8 nozzles and may be adapted according to the number of nozzles to which null data is assigned, for example, 4 nozzles. In other words, the unit for drive control does not have to agree with a conveying distance corresponding to 16 nozzles.

According to the three embodiments, as described above, the inclination of arrangement of a nozzle array can be corrected at a resolution higher than that of image data. In addition, the inclination of arrangement of a nozzle array can be more exactly corrected stepwise by shifting print data in units of a nozzle group including a predetermined number of nozzles.

Other Exemplary Embodiments

The unit for drive control and the number of blocks in the print buffer, for example, are not limited to the values specified in the embodiments described above. In addition, the print buffer used may have a capacity smaller than the volume of recording data for each scanning operation. If, for example, the recording buffer has less than eight blocks (for example, two or three blocks), the blocks may be repeatedly used by rewriting recorded data. Although the shift register block 35 has the function of setting null data in the embodiments described above, an additional circuit block having the function may be provided in the print head control block 24.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-188292 filed Jun. 28, 2005, which is hereby incorporated by reference herein in its entirety.

What is claimed is:

1. A recording method for recording by using a recording head having a nozzle array including a plurality of nozzles based on recording data, the nozzles being divided into a plurality of groups, the nozzles included in each of the plurality of groups being divided into a plurality of blocks and by driving each block time-divisionally, the method comprising:

generating a timing signal periodically, for generating a plurality of the timing signals within a predetermined time period, based on a scanning speed of the recording head and a resolution of the recording with regard to a scanning direction;

determining, for each group, a timing signal to be driven and a timing signal not to be driven, with regard to each timing signal of the plurality of the timing signals, according to information on misalignment of the nozzle array;

reading the recording data of one column from a recording buffer in accordance with the predetermined time period;

rearranging the recording data read in the reading step corresponding to the block;

assigning, for each group, null data to the timing signal not to be driven and the recording data to the timing signal to be driven, based on a result of the determining; and driving the recording head in synchronization with the timing signal by block, based on data assigned to each group.

2. The method according to claim 1, wherein the information on misalignment of the nozzle array includes a plurality of misalignment data, each respective misalignment data associated with each respective nozzle group.

3. The method according to claim 2, wherein each respective misalignment data indicates an amount of inclination in a scanning direction of the recording head.

4. The method according to claim 1, wherein each of the groups includes a predetermined number of nozzles.

5. The recording method according to claim 4, wherein the predetermined number is selected according to the number of bits of data stored in a recording buffer.

6. The recording method according to claim 4, wherein the predetermined number corresponds to 1/n (wherein n is an integer) of the number of bits of data stored in a recording buffer.

7. The recording method according to claim 1, further comprising:

storing the recording data in a recording buffer separately for each of the groups according to the information on the misalignment of the nozzle array.

8. The recording method according to claim 7, wherein the recording data is stored at addresses in the recording buffer which correspond to a scanning direction of the recording head according to the information on the misalignment of the nozzle array.

9. The recording method according to claim 8, wherein the recording buffer has a recording region divided into a plurality of blocks in the scanning direction to store the recording data for each of the blocks.

10. The recording method according to claim 8, wherein the recording buffer has a recording region divided into a plurality of blocks in the scanning direction to store the recording data for each of the blocks; and the position where the storing of the recording data in each of the blocks is started is changed according to the information on the misalignment of the nozzle array.

11. The recording method according to claim 1, wherein a number of bits of the generated null data is equal to a number of nozzles of the group.

12. A recording apparatus for performing recording by using a recording head having a nozzle array including a plurality of nozzles based on recording data, the nozzles being divided into a plurality of groups, the nozzles included in each of the plurality of groups being divided into a plurality of blocks and by driving each block time-divisionally, the apparatus comprising:

a signal generating unit configured to generate a timing signal periodically, for generating a plurality of the timing signals within a predetermined time period, based on a scanning speed of the recording head and a resolution of the recording with regard to a scanning direction;

a determining unit configured to determine, for each group, a timing signal to be driven and a timing signal not to be driven, with regard to each timing signal of the plurality of the timing signals, according to information on misalignment of the nozzle array;

a recording buffer configured to store recording data including a plurality of columns;

a reading unit configured to read the recording data of one column from the recording buffer in accordance with the predetermined time period;

a data generating unit configured to rearrange the recording data read by the reading unit corresponding to the block;

an assigning unit configured to assign, for each group, null data to the timing signal not to be driven and the recording data to the timing signal to be driven, based on a determined result by the determining unit; and a driving unit configured to drive the recording head in synchronization with the timing signal by block, based on data assigned to each group.

13. The apparatus according to claim 12, wherein each of the groups includes a predetermined number of nozzles.

14. The recording apparatus according to claim 12, wherein the generating unit is configured to generate the timing signal according to scanning of the recording head.

* * * * *